US007037207B1

(12) United States Patent
Bean, Jr.

(10) Patent No.: US 7,037,207 B1
(45) Date of Patent: May 2, 2006

(54) BALL TEEING APPARATUS

(76) Inventor: Terrell W. Bean, Jr., 7157 Bay Cove Trail, Nashville, TN (US) 37221

( * ) Notice: Subject to any disclaimer, the term of this patent is extended or adjusted under 35 U.S.C. 154(b) by 10 days.

(21) Appl. No.: 10/940,861

(22) Filed: Sep. 14, 2004

(51) Int. Cl.
*A63B 69/36* (2006.01)

(52) U.S. Cl. ..... 473/137

(58) Field of Classification Search ..... 473/132–137
See application file for complete search history.

(56) References Cited

U.S. PATENT DOCUMENTS

| | | | | |
|---|---|---|---|---|
| 3,584,614 | A * | 6/1971 | Horvath | 124/56 |
| 4,796,893 | A | 1/1989 | Choi | |
| 4,892,318 | A * | 1/1990 | Jennings | 473/137 |
| 4,957,296 | A * | 9/1990 | Turnidge et al. | 473/137 |
| 5,259,622 | A | 11/1993 | Irving | |
| 5,326,107 | A | 7/1994 | Park | |
| 5,346,222 | A | 9/1994 | Luther, Sr. | |
| D351,439 | S | 10/1994 | Halpern | |
| 5,549,518 | A * | 8/1996 | Wang | 473/137 |
| 5,603,664 | A * | 2/1997 | Provost | 473/134 |
| 5,624,325 | A | 4/1997 | Smith | |
| 5,704,844 | A | 1/1998 | Luther | |
| 5,820,475 | A | 10/1998 | Luna | |
| 6,159,105 | A | 12/2000 | Henry | |
| 6,315,676 | B1 | 11/2001 | Sandlin | |
| 6,328,659 | B1 | 12/2001 | Peterson | |
| 6,419,589 | B1 | 7/2002 | Carter | |
| 6,585,603 | B1 | 7/2003 | Montalvo | |
| 6,616,541 | B1 | 9/2003 | Michelizza | |
| 6,685,575 | B1 | 2/2004 | Anderson | |
| 2003/0027654 | A1 | 2/2003 | Hong | |

OTHER PUBLICATIONS

Web Page—http://www.fronygate.com/fg/pdp.jsp?prod_oid=3836496&showarrow=y&search=y&cursor=1.

* cited by examiner

*Primary Examiner*—Steven Wong
(74) *Attorney, Agent, or Firm*—Waddey & Patterson, P.C.; Howard H. Bayless

(57) ABSTRACT

An apparatus for dispensing one golf ball at a time onto a tee, the apparatus includes: a frame supporting a collapsible funnel shaped hopper, a lifting housing, a lifting plunger assembly and a counterweighted tubular arm. The funnel shaped hopper has a wide upper mouth to receive a plurality of golf balls and a smaller lower exit port through which golf balls roll by gravity into lifting housing. The lifting housing receives one or more golf balls via a feed port and allows one golf ball to rest against a ball stop portion of the housing wall in a chambered position. A lifting plunger prevents the golf ball from falling further into the lifting housing. The counterweighted tubular arm is pivotably attached to the frame, the arm being biased by the counterweight to hold its dispensing mouth at an elevation higher than the lifting housing dispensing port. A golfer standing in a golf stance uses a club to manually pivot the tubular arm to a dispensing position where the dispensing mouth is at a lower elevation than the lifting housing discharge port and whereby the tubular arm operates a lifting actuator to move the lifting plunger so as to cause a golf ball in the chambered position to be raised above and discharged from dispensing mouth. The dispensing mouth is shaped to dispense one golf ball through the mouth onto a tee.

13 Claims, 5 Drawing Sheets

BALL TEEING APPARATUS

BACKGROUND OF THE INVENTION

The present invention relates generally to devices for teeing golf balls. More particularly, this invention pertains to portable, automatic golf ball teeing devices.

Golf driving ranges are frequently used by golf enthusiast desiring to improve their golf swing by repetitively hitting tee shots from a single location over a short period of time. A supply of golf balls is provided and the golfer hits them one at a time from a teeing area into a field. Each golf ball is to be teed up before hitting. The golfer must bend over before each shot to place a ball on a tee, which may be the familiar wooden or plastic tee pushed into the ground, or it may be a flexible rubber tube built into a mat or set permanently in the ground.

Unfortunately, reaching for a ball from the supply bucket and bending over at the waist to place a new ball on the tee require the golfer to move from a proper golf stance to tee the ball. After teeing the new ball, the golfer will then need to reassume a desired golf stance before striking the newly teed golf ball. Most golfers will recognize that movement into and out of a desired golf stance is undesirable. Each time the golfer attempts to assume the desired golf stance there are some differences in the stance, such as foot placement, alignment and distance from the tee. This repetitive changing of golf stance is detrimental to developing a consistent golf swing. Movement from the golf stance should be avoided.

Thus, an automatic teeing apparatus would be very desirable. Many such devices have been suggested in the past employing different systems to provide one teed-up golf ball at a time. Most automatic teeing systems involve a swinging arm to transfer a golf ball from a reservoir of balls to a tee. Typical of such systems are those described in U.S. Pat. Nos. 4,796,893; 5,259,622 and 5,346,222. These prior art teeing devices frequently require the golfer to operate a foot pedal, or other wise move from the golfer's golf stance, to dispense a golf ball on the tee. This common feature of the automatic teeing devices is very detrimental to the desired practice condition of remaining in a golf stance.

Thus, an automatic teeing apparatus that is operable from a golf stance would be very desirable.

Additionally, while these prior art devices have many desirable features, they do not provide the most simple, economical, yet efficient and useful apparatus that can be devised. For example, some of the prior art devices require foot pedals for actuation of mechanical gears. Others use long magazines and systems of springs and pulleys. None operate solely by the force of gravity and operator manipulation from the golf stance. Also, none can be easily made from cheap, easily obtainable extruded plastic piping configured so as to function with fit tolerances much greater than most geared systems.

Thus, an automatic teeing apparatus that is inexpensive, compact, and portable and that is operable by the force of gravity and operator manipulation from a golf stance would be very desirable.

SUMMARY OF THE INVENTION

A portable apparatus for dispensing one golf ball at a time onto a tee is disclosed. In one embodiment the apparatus includes a retractably extendable tubular a frame supporting a collapsible funnel shaped hopper. The frame is made of inexpensive extruded plastic piping. A dispensing housing is disposed within the frame and includes a dispensing chamber and a lifting plunger positioned by a lifting actuator. The lifting actuator is operated by user manipulation of a tubular dispensing arm.

A funnel shaped hopper is supported by the frame. The hopper has a wide upper mouth to receive a plurality of golf balls and a smaller lower exit port through which golf balls fall by gravity into the dispensing chamber via a feed port. In one embodiment the hopper is a funnel formed from textile fabric sheet.

In the dispensing housing, one golf ball rests against a ball stop portion of the housing wall in a chambered position. The lifting plunger prevents the golf ball from falling further into the dispensing housing. A counterweighted tubular arm is pivotably attached to the frame. The arm is biased by the counterweight to hold its dispensing mouth at an elevation higher than the lifting housing dispensing port.

A golfer standing in a golf stance before the apparatus uses a club to engage a club hook on the distal end of the tubular arm so as to pivot the tubular arm to a lowered (dispensing) position where the dispensing mouth is at a lower elevation than the lifting housing discharge port and whereby the tubular arm operates the lifting actuator to move the lifting plunger. Upward movement of the lifting plunger causes a golf ball in the chambered position to be raised above and discharged from dispensing port of the dispensing housing. The golf ball rolls in and down the tubular arm to the dispensing mouth. The dispensing mouth is shaped to dispense the golf ball through the mouth onto a tee. Release of the hook club causes the tubular arm to swing upwards and away from the teed golf ball.

DESCRIPTION OF THE PREFERRED EMBODIMENTS

Figure 1:
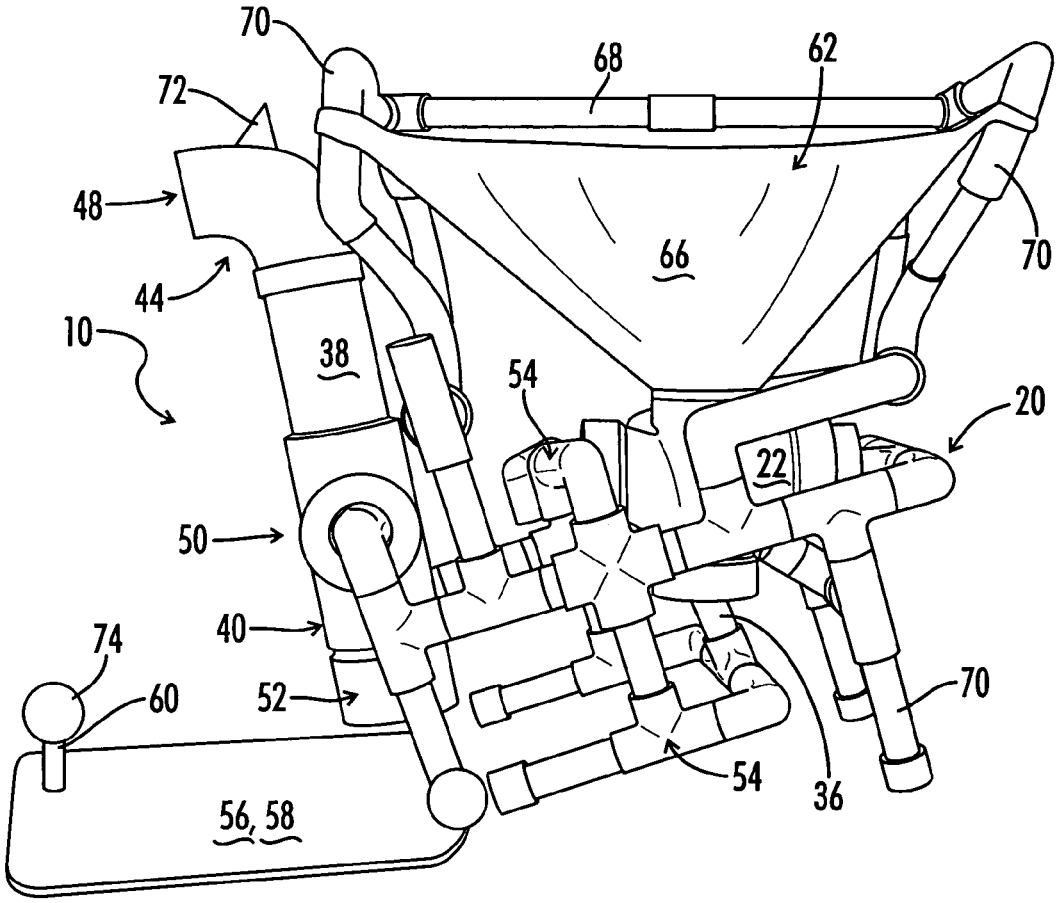
FIG. 1 is a lateral view of one embodiment of the golf ball dispensing apparatus of the present invention.
Figure 2:
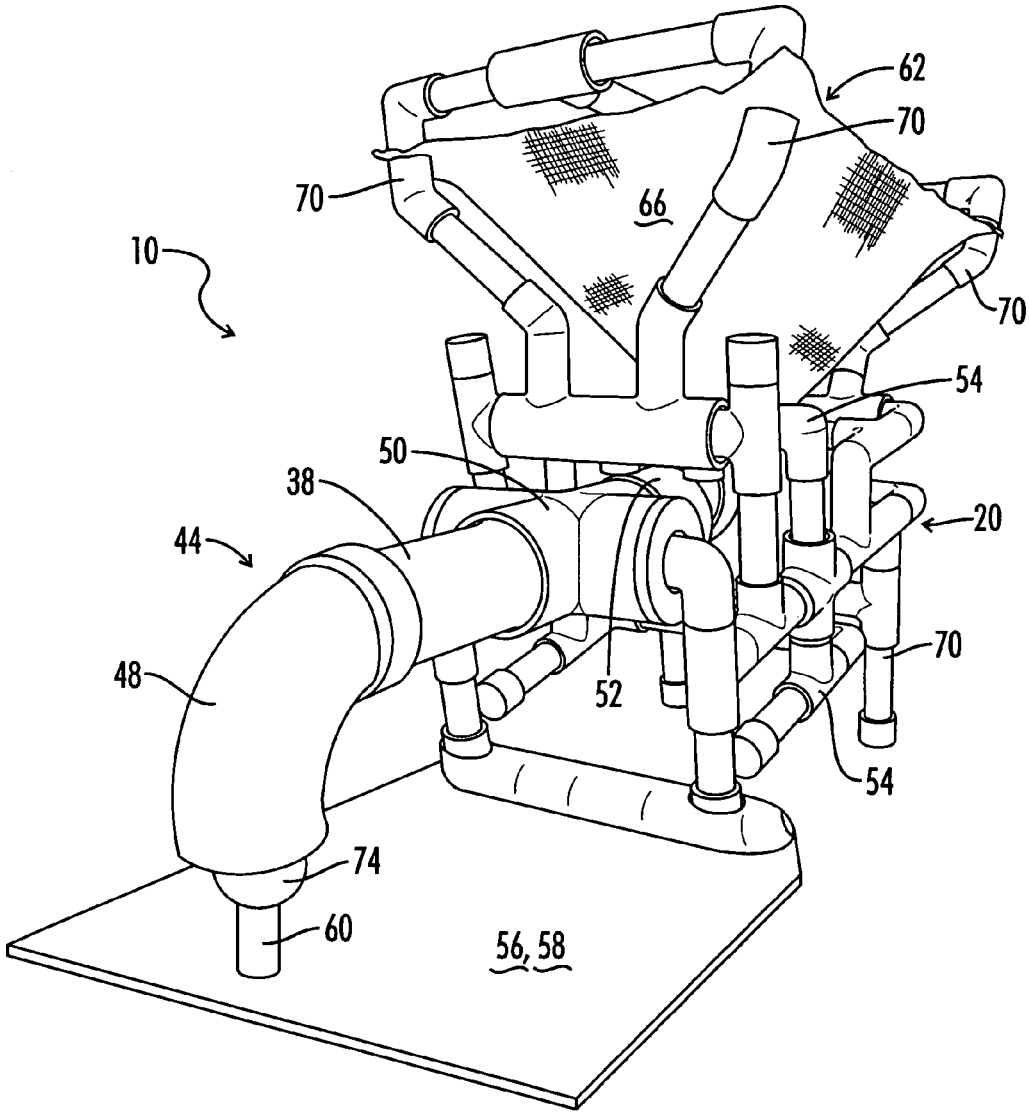
FIG. 2 is an oblique view of the embodiment shown in FIG. 1.

Referring now to FIG. 1, one embodiment of the golf ball dispensing apparatus (10) of this invention is shown with the tubular arm (38) of the apparatus (10) in the upper position. FIG. 2 shows the apparatus (10) with the tubular arm (38) in the lower position dispensing a golf ball (74) on the tee (60) of the apparatus. The golf ball teeing apparatus (10) shown in FIGS. 1 and 2 also includes a frame (20), a hopper (62), a dispensing housing (22), a lifting plunger (36), and a lifting actuator (54). These components operate to receive a plurality of golf balls (74) in the hopper (62) and individually dispense them and align them atop a tee (60).

The frame (20) of this apparatus consists of portions of PVC piping assembled so as to have collapsible and extendable portions of the frame (68). This adjustable frame member (70) allow for the frame to be collapsed into a retracted configuration (not shown) for ease of storage, transport and set-up. When positioned in a tee box for usage, the collapsible and extendable portions of the frame (68) can then be configured in an extended configuration to support the hopper and to adjust the relative elevation of the dispensing housing (22) and the tubular arm (38) so that a golf ball dispensed by the housing (22) rolls through the tubular arm (38) and is dispensed upon the tee (60).

In the embodiment of the invention shown in FIGS. 1 and 2, the hopper (62) is a collapsible funnel (66) made of a textile sheet. The collapsible funnel (66) is supported by the adjustable frame members (70). The collapsible funnel (66) has a wide mouth to receive a bucket of golf balls, which in industry standards typically contain approximate 100 golf balls. These golf balls are gravity fed via a lower port (not shown) into the dispensing housing (22). In this embodiment of the invention the collapsible funnel (66) is glued to the dispensing housing (22). In alternate embodiments of the invention, the collapsible funnel (66) is detachably joined to the dispensing housing (22) and is detachably joined to the frame (20) for easy removal and replacement. While the embodiment of the invention shown in FIGS. 1 and 2 employs a hopper (62) made of a sheet of textile material shaped into a collapsible funnel (66), other embodiments may use a rigid hopper (62) formed from plastic or metal materials and shaped in any of a number of convenient configurations.

Figure 3:
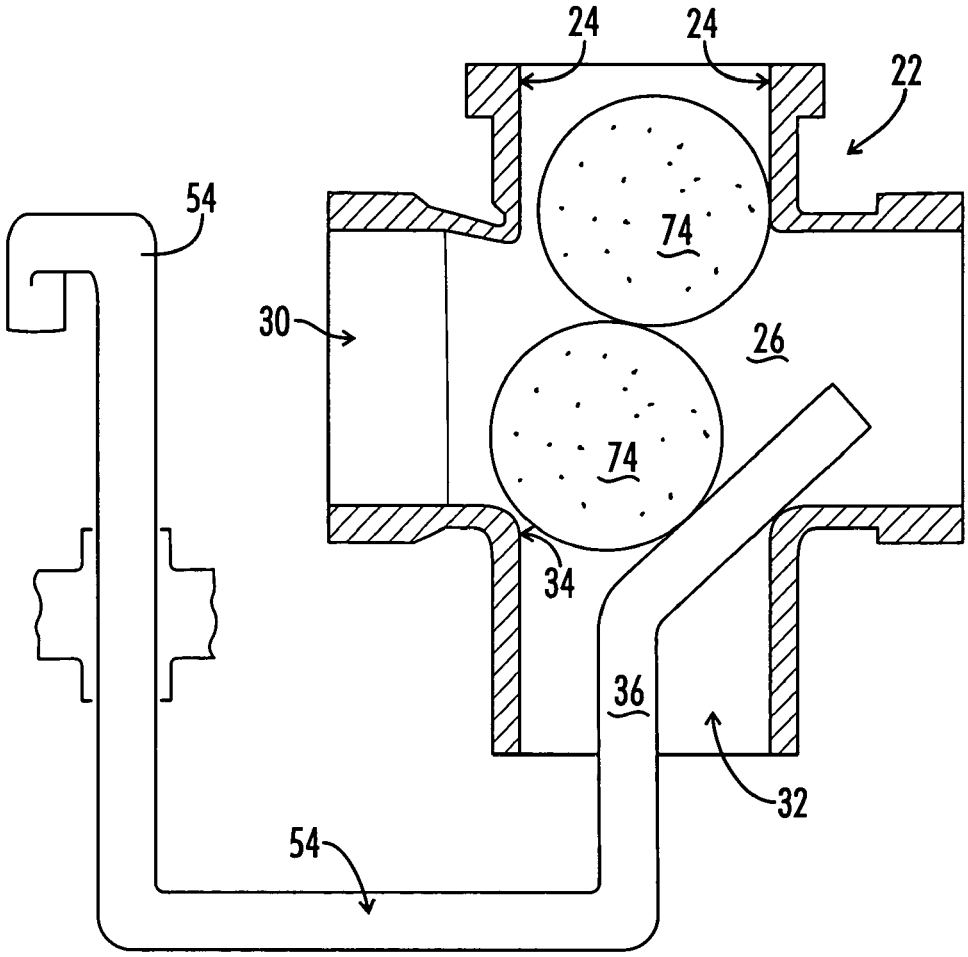
FIG. 3 is a cross-sectional detail view of the dispensing housing of the embodiment shown FIG. 1 showing a golf ball in the chambered position.
Figure 4:
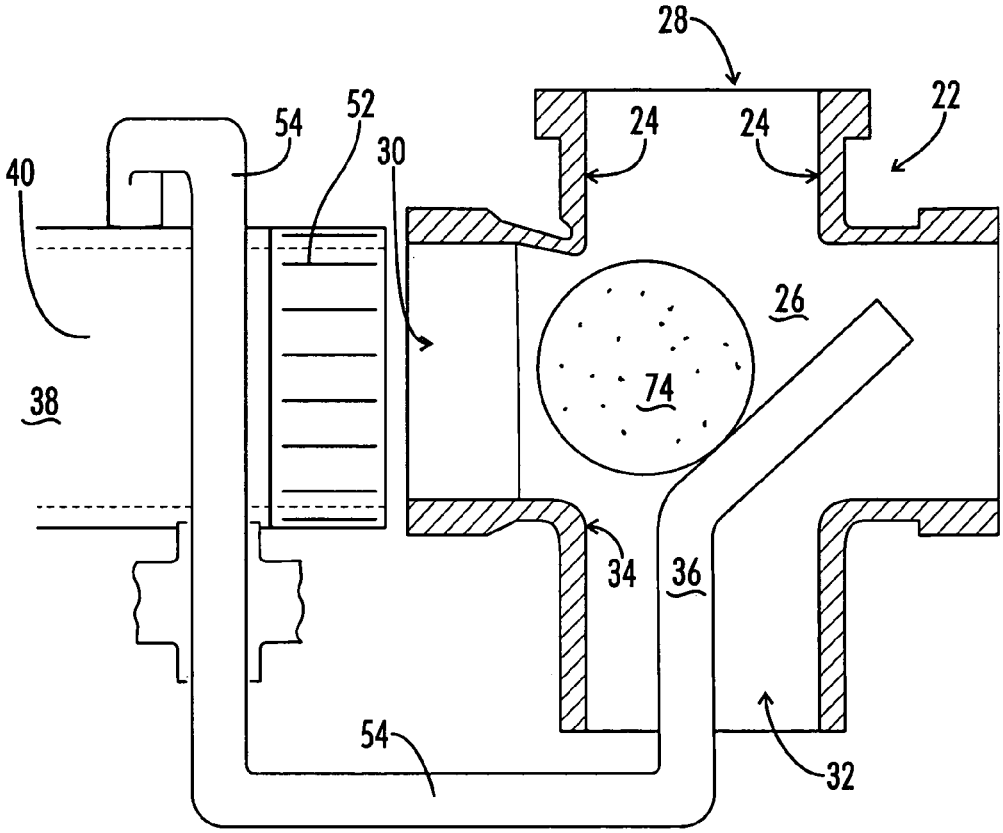
FIG. 4 is a cross-sectional detail view of the dispensing housing of the embodiment shown FIG. 1 showing a golf ball in the discharge position.

Referring now to FIGS. 3 and 4, a cross-sectional detail of the dispensing housing (22) of the embodiment of the invention shown in FIGS. 1 and 2 is presented. The dispensing housing (22) has a dispensing chamber (26) formed by the inner housing wall (24). Three openings to the dispensing chamber (26) are shown including the feed port (28), which is adapted to receive balls from the hopper (62) by gravity feed. In the embodiment shown in FIGS. 1 and 2, golf balls fall from the hopper (62) through the feed port (28) into the dispensing chamber (26).

Referring now to FIG. 3, a lifting plunger (36) cooperates with a ball stop (34) disposed within the housing (22) beneath a dispensing port (30) to receive a single golf ball (74) and hold it in a chambered position beneath the dispensing port (30). The lifting plunger (36) extends through the plunger port (32) and is mechanically connected to the lifting actuator (54).

Referring now to FIG. 4. The lifting plunger (36) is shown lifting the golf ball (74) that was previously in the chambered position to a position above the ball stop (34). The golf ball is now adjacent the discharge port (30) and in a discharge position. In this discharge position the golf ball (74) will be roll from the dispensing housing (22) via the dispensing port (30) by gravity feed. The dispensing chamber (26) is shaped such that, in the region of the chamber between the chambered position and the discharge position, no more than a single golf ball is received in that portion of the dispensing chamber (26) at any one time. This feature allows a single operation of the lifting plunger (36) from the chambered position to the discharged position to discharge a single golf ball into the dispensing port (30).

Referring again to FIG. 1, a tubular arm (38) is shown in an upper configuration. The tubular arm (38) in this embodiment of the invention includes portions of PVC piping arranged to form a proximal end (40) having a counter weight (52) that biases the tubular arm (38) towards the upper position shown. The tubular arm (38) is joined to the frame (20) by a pivot portion (50) about which the tubular arm (38) is movable between the upper position shown in FIG. 1 and the lower position shown in FIG. 2. A distal end (44) is shown and includes a dispensing mount (48) shaped for dispensing a golf ball (74) upon a tee (60).

Referring now to FIG. 4, the cross-sectional detail of the dispensing housing (22) and the tubular arm (38) is shown in a lowered configuration having the proximal end (40) positioned to receive the golf ball (74) from the dispensing port (30). The lifting actuator (54) receives the proximal end (40) of the swinging tubular arm (38) and, being raised itself by the tubular arm (38), lifts the lifting plunger (36) from the chambered position to the discharged position causing the golf ball (74) to be lifted from a chambered position in the dispensing chamber (26) to a discharge position above the ball stop (34) and proximate to the dispensing port (30). In this lowered position, the tubular arm (38) generally aligns with the dispensing port (30) so as to receive any golf ball (74) that is discharged through the dispensing port (30).

Referring now to FIG. 2, the golf ball teeing apparatus (10) of the present invention is shown with the tubular arm (38) in the lowered position. The tubular arm (38) and the frame (20) are adjusted such that the golf ball (74) rolls from the dispensing port (30), down through the proximal end (40) of the tubular arm (38), into the distal end (44) and is deposited by the dispensing mouth (44) upon a tee centered with respect to the dispensing mouth (48).

A greens portion (56) is positioned adjacent to the frame (20) and includes a mat (58), which simulates a portion of the tee box ground surface. A tee (60) mounted on the mat (58). In the embodiment shown, the mat (58) is removably attached to the frame (20) and adjusted such that the tee (60) is centered with respect to the dispensing mouth (48) of the tubular arm (38) when the tubular arm (38) is in the lower position. In the embodiment, the mat (58) is a flexible sheet of synthetic grass like material, such as Astroturf. Other embodiments utilize rubberized or plastic mats. Some embodiments use detachable mats (58). This feature allows the mat (58) to be rolled into a convenient package for transportation and storage.

Figure 5:
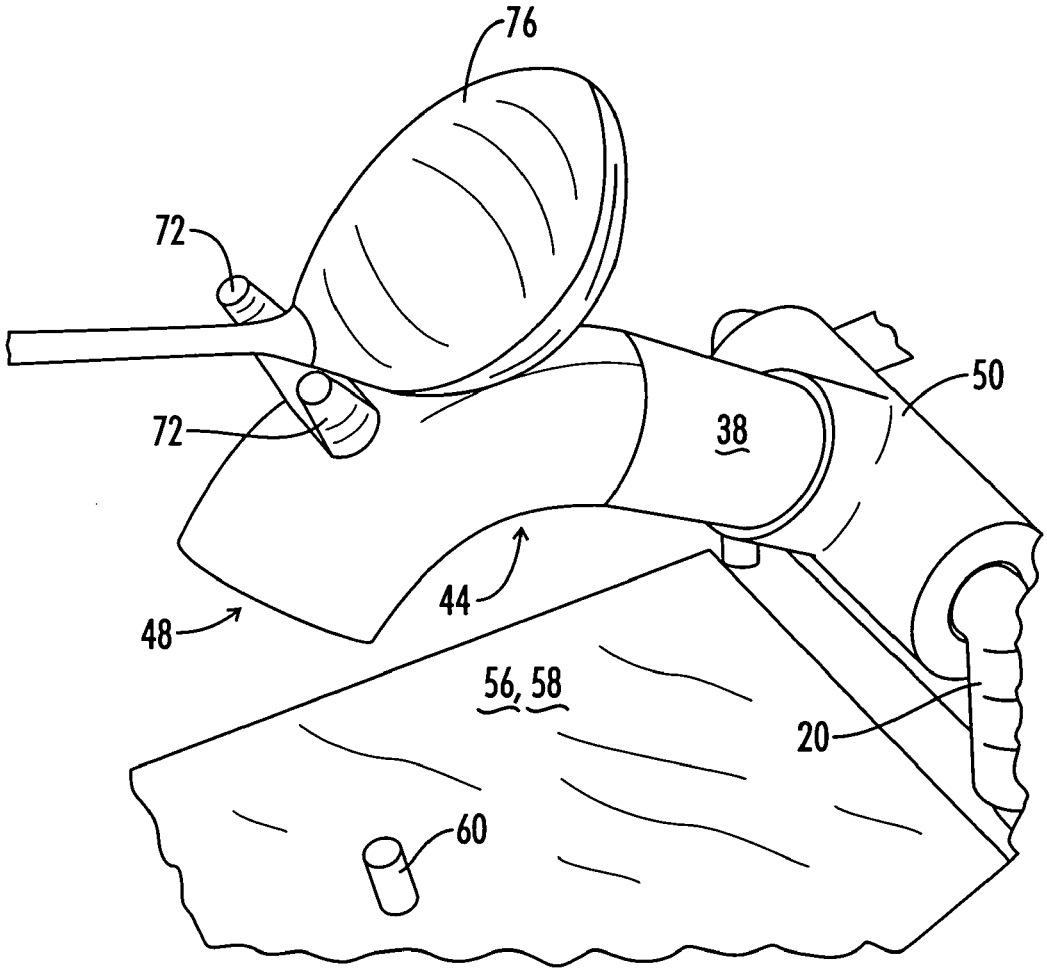
FIG. 5 is an oblique detail view of the club head operably engaging the distal end of the tubular arm of the embodiment shown in FIG. 1.

A novel feature of the present invention is the club hook (72) shown in the detailed view of the embodiment of the present invention shown in FIG. 5. The club hook (72) is shown receiving the club head (76) used by a golfer standing in a golf stance before the golf ball teeing apparatus (10). This operational feature of the apparatus (10) allows the golfer to maintain a golf stance while using the golf club head (76) to manipulate the tubular arm (38) to operate the apparatus (10). Using the golf club head (76, the golfer moves the tubular arm (38) from an upper position to a lower position and thus dispenses a golf ball (74) upon the tee (60). The golfer then removes the club head (76) from the hook (72). The counter weight (52) biases the tubular arm (38) and the tubular arm (38) swings upwards to an upper position. The golf ball is then teed upon the golf teeing apparatus (10) as shown in FIG. 1 and is ready for the golfer's swing. This process can be repeated as desired until the entire supply of golf balls is exhausted without the need for the golfer to move from the golf stance. As stated above, this is a very desirable feature and greatly improves the utility of the golf teeing apparatus in allowing the golfer to maintain consistency of swing by staying in a single golf stance throughout a series of practice swings.

Thus, although there have been described particular embodiments of the present invention of a new and useful Ball Teeing Apparatus, it is not intended that such references be construed as limitations upon the scope of this invention except as set forth in the following claims.

What is claimed is:

1. A golf ball dispensing apparatus comprising:

a frame;

a dispensing housing disposed within the frame, said housing including:

an inner housing wall disposed within the housing and defining a dispensing chamber, said dispensing chamber having:

a feed port adapted to receive golf balls into the dispensing chamber by gravity feed;

a dispensing port adapted to discharge golf balls from the dispensing chamber by gravity feed; and a plunger port;

a ball stop disposed within the housing beneath the dispensing port, said ball stop adapted to receive and hold in a chambered position beneath the discharge port such single golf ball as received by the ball stop; and a lifting plunger received within the dispensing chamber through the plunger port, the lifting plunger being operably adapted to lift such golf ball above the ball stop to a discharge position adjacent the discharge port, each operation of the lifting plunger discharging into the dispensing port such single golf ball as is held in a chambered position;

a tubular arm adapted to pass a golf ball, said tubular arm having:

a proximal end adapted to receive a golf ball;

a distal end forming a dispensing mouth for dispensing a golf ball therefrom;

a pivot portion between the proximal and distal ends, the tubular arm pivotally disposed upon the frame at the pivot section; and a counterweight disposed upon the proximal end so as to bias the tubular arm towards an upper position, the tubular arm rotably movable between the upper position and a lower position; and a lifting actuator in mechanical communication with the lifting plunger, said lifting actuator adapted to receive the proximal end of the tubular arm as the tubular arm rotates toward the lower position so as operate the lifting plunger, wherein, with the tubular arm in the lower position, the proximal end is aligned along and proximate to the dispensing port so as to receive such golf ball as is discharged by the dispensing housing, and the dispensing mouth is adapted and arranged to deposit the golf ball being discharged from the dispensing mouth onto a tee centered with respect to the mouth.

2. The apparatus of claim 1, the ball teeing apparatus further comprising:

a greens portion comprising:

a mat adapted to simulate a portion of the ground surface of a tee box; and a tee disposed upon the flexible mat and centered with respect to the dispensing mouth with the tubular arm in the lower position.

3. The apparatus of claim 2, the mat comprising a flexible sheet detachably affixed to the frame.

4. The apparatus of claim 1, the ball teeing apparatus further comprising:

a hopper disposed upon the frame and positioned above the feed port, the hopper adapted to receive a plurality of golf balls and to supply such balls by gravity through a lower port and into the feed port.

5. The apparatus of claim 4, the hopper comprising a collapsible funnel, detachably affixed to the frame.

6. The apparatus of claim 5, the collapsible funnel comprising a textile material.

7. The apparatus of claim 5, the frame comprising a collapsible frame.

8. The apparatus of claim 7, the collapsible frame adapted to support the collapsible funnel during operation of the ball teeing assembly.

9. The apparatus of claim 8, the collapsible frame further comprising adjustable frame members, said adjustable frame members adapted to retractably extend from a retracted configuration to an extended configuration.

10. The apparatus of claim 9, wherein, the adjustable frame members being in a retracted configuration, the dimensions of the ball teeing apparatus are suitable for transportation by hand, and wherein, wherein, the adjustable frame members being in an extended configuration, the dimensions of the ball teeing apparatus are suitable for stable positioning of the ball teeing apparatus upon a driving surface.

11. The apparatus of claim 1, wherein the lifting actuator is slidably disposed upon the frame, wherein, the lifting plunger is operable between a lowered position and a lifted position, wherein, with the lifting plunger in the lowered position, the lifting plunger cooperates with the ball stop to receive and hold in the chambered position beneath the discharge port such single ball as received by the lifting plunger, wherein, the lifting plunger is operably adapted to lift such ball above the ball stop to the discharge position adjacent the discharge port, and wherein, each operation of the lifting plunger discharges into the dispensing port not more than a single ball of the plurality of balls.

12. The apparatus of claim 1, wherein the tubular arm further comprising a club hook disposed upon the distal end and operably adapted to receive a golf club head for operator manipulation of the tubular arm from the upper position to the lower position.

13. The apparatus of claim 1, the dispensing chamber adapted such that only one single golf ball may be received at any one time within the dispensing chamber in the portion of the dispensing chamber between the chambered position and the discharge position.

* * * * *